United States Patent [19]

Sovis et al.

[11] Patent Number: 4,633,543

[45] Date of Patent: Jan. 6, 1987

[54] HAND VACUUM CLEANER

[75] Inventors: John F. Sovis, Coldwater, Mich.; Robert M. Smith, Copley, Ohio; George H. Bramhall, Boulder, Colo.

[73] Assignee: Royal Appliance Mfg. Co., Cleveland, Ohio

[21] Appl. No.: 670,553

[22] Filed: Nov. 9, 1984

[51] Int. Cl.[4] ..... A47L 5/26

[52] U.S. Cl. ..... 15/344; 15/413

[58] Field of Search ..... 15/344, 413

[56] References Cited

U.S. PATENT DOCUMENTS

| | | | |
|---|---|---|---|
| 1,861,261 | 5/1932 | Carson . | |
| 1,871,624 | 8/1932 | Loewinsohn . | |
| 1,878,858 | 9/1932 | Kitto | 15/413 |
| 2,184,446 | 12/1939 | Snyder | 15/413 |
| 2,309,583 | 1/1943 | Frantz | 15/344 |
| 2,395,430 | 2/1946 | Sloan | 15/344 X |
| 3,334,370 | 8/1967 | Boyd | 15/344 X |
| 3,397,517 | 8/1968 | De Vigan . | |
| 3,477,087 | 11/1969 | Robinson . | |
| 3,513,500 | 5/1970 | Hori . | |
| 3,599,273 | 8/1971 | Shirayanagi et al. . | |
| 3,665,006 | 5/1972 | Valbona et al. . | |
| 3,667,084 | 6/1972 | Valbona et al. . | |
| 4,011,624 | 3/1977 | Proett . | |
| 4,052,765 | 10/1977 | Gühne et al. . | |
| 4,209,875 | 7/1980 | Pugh et al. . | |
| 4,213,224 | 7/1980 | Miller . | |
| 4,573,234 | 3/1986 | Kochte et al. | 15/344 X |

FOREIGN PATENT DOCUMENTS

| | | | |
|---|---|---|---|
| 571913 | 10/1958 | Belgium | 15/413 |
| 694801 | 8/1940 | Fed. Rep. of Germany | 15/344 |
| 538613 | 8/1941 | United Kingdom | 15/413 |

OTHER PUBLICATIONS

Photographs of a vacuum broom motor housing believed to have been sold more than 1 yr. prior to the filing date of the application.

*Primary Examiner*—Chris K. Moore

*Attorney, Agent, or Firm*—Fay, Sharpe, Fagan, Minnich & McKee

[57] ABSTRACT

A hand vacuum cleaner is provided comprising a lightweight motor housing containing a revolving brush. A bag assembly is selectively separable from the housing and is sealable to the housing with an elastomeric retaining ring including a sealing and retaining bead for reception in a recessed slot area of a housing bag attachment collar. A fan is mounted to the motor on a motor shaft locking surface including a wall portion tapering towards the fan. The shaft is in locking cooperation with a mating fan bore locking surface including a wall portion tapered for close reception of the motor shaft locking surface. A shaft extension is threadedly received on the motor shaft and is urged into engagement against the fan by resistance of a revolving brush operated by a belt received on the shaft extension which continually tightens the shaft extension to the motor shaft and fixes the fan to the motor shaft. A stone shield is circumferentially spaced about the fan whereby the stone shield block items impinging against the housing from the fan from damaging the housing.

2 Claims, 12 Drawing Figures

2B
2B 127
120

20
3
3
74
66
68
72
18
16
2D
2D
120
64
65
124
70
60
122
120
120
126
62
22
30
26
32
40
36
26
52
34
32
46
48
30
38
50
42

HAND VACUUM CLEANER

BACKGROUND OF THE INVENTION

This invention pertains to the art of vacuum cleaner devices and more particularly to a hand vacuum cleaner.

The invention is particularly applicable as a device for suction cleaning items and places where conventional larger sized vacuums are inconvenient and, more particularly, where a hand held vacuum with a revolving brush that provides a vibrating and sweeping action is particularly advantageous.

Various forms and types of hand vacuums have heretofore been suggested and employed for both commercial and domestic use, all with varying degrees of success. It has been found that these prior hand vacuums have suffered from a variety of problems which limit their practical and economic value.

A principal problem with these prior art devices is that in order to obtain powerful suction with a revolving brush the hand vacuums have been relatively heavy since they have typically been constructed of a metal casing to support a powerful suction motor and absorb the vibrations of a revolving brush. In addition, it has been found that a metal casing has been necessary to withstand the forces of impinging articles against the casing walls which have been propelled against the walls by the cleaner during operation. Mere lightweight plastic materials have been unable to withstand the forces of such impinging articles over a period of time without risk of damage to the casing itself, or, at worst, propelling an item out from a broken casing towards an operator of the cleaner.

Another common problem with hand held vacuum cleaners is the provision of a convenient yet effective means for sealing a dirt and soil collecting bag to the cleaner housing. It is important that the bag may be easily separable from the cleaner for emptying, but it is also important that a dust tight seal be made upon reattachment of the bag to the cleaner and that such dust tight seal must be capable of being maintained over a large number of operations of removal and reattachment of the bag. Most conventional type hand vacuum cleaners which merely use an elastomeric gasket in combination with a mechanical camming device to seal the bag to the vacuum housing have been unsuccessful over a period of time due to deformation of the gasket and mechanical relaxation of the camming parts. As dust leaks from such a hand vacuum during operation, it is particularly noticeable to an operator and, accordingly, a most unattractive and undesirable type of cleaner failure.

Another problem with prior hand held vacuum cleaner designs, and particularly those including a revolving brush in the cleaner nozzle, is the provision of an efficient means of translating the torque forces from the motor to the fan and revolving brush while minimizing vibration to the housing and bearing elements and to maintain these elements in the assembly in a secure manner. Typically, prior art designs have employed mechanical fastening devices which have not only added weight to the construction, but are still susceptible to loosening due to the vibrational forces of the cleaner.

Yet another problem with prior hand held vacuum cleaner designs has been the disadvantages associated with cooling the vacuum motor with working air laden with dirt and dust particles. Due to the desirability of keeping a hand vacuum as compact as possible, problems have developed in designing a cooling air flow path which could be segregated from the working air.

Yet another problem with hand held vacuum cleaners due to their compactness has been the interference of objects drawn in by the working air with the vacuum fan after the particles have been collected into the vacuum bag when they are not inhibited from rolling back to the fan after the cleaner has been turned off. This is a particular problem in hand held vacuum cleaners where the cleaners are operated in a variety of different positions and situations and it is likely for gravitational forces to urge solid objects back towards the nozzle of the cleaner.

The present invention contemplates a new and improved hand vacuum cleaner which overcomes all the above referred to problems and others to provide a new hand vacuum which is simple in design, economical to manufacture, compact and lightweight, but provides powerful suction action with a revolving brush, readily adaptable to a plurality of uses in a variety of cleaning situations, easy to assemble, easy to operate, easy to detach, empty and reattach the cleaner bag and which provides improved hand vacuum cleaner operation.

BRIEF SUMMARY OF THE INVENTION

In accordance with the present invention, there is provided a hand held vacuum cleaner having a housing, rotating brush, and selectively separable bag assembly. The housing includes a bag attachment collar having a recessed slot area for reception of an elastomeric retaining ring having a sealing and retaining bead of the bag assembly. The bag assembly is positively sealed during operation to the housing to substantially preclude passing of dust particles.

In accordance with another aspect of the invention, the housing further contains a motor and fan for drawing in air from a housing nozzle. The fan is mounted to the motor at a motor shaft locking surface including a wall portion tapering towards the fan. The shaft locking surface is in locking cooperation with a mating fan bore locking surface including a wall portion tapered for close reception of the motor shaft locking surface. A motor shaft extension and belt for driving the revolving brush is provided. The shaft extension is threadedly mounted to the motor shaft and the belt is received on the shaft extension. The fan is received on the motor shaft intermediate of the motor and the shaft extension in engagement to the shaft extension whereby a torque applied by resistance of the belt and brush to shaft rotation continually tightens the shaft extension to the motor shaft and fixes the fan to the motor shaft.

In accordance with another aspect of the present invention, the housing further includes a stone shield circumferentially spaced about the fan whereby the stone shield blocks items impinging against the housing from the fan from damaging the housing. The stone shield includes a side wall having an upper portion tapered away from the front wall to preclude perpendicular impingement of the items against the side wall.

In accordance with a further aspect of the present invention, the housing includes a nozzle assembly having a nozzle with integrally formed opposite first and second bearing housing cavities, the cavities being sized to closely receive first and second bearing housings of the revolving brush. A nozzle guard includes first and second bearing housing retaining elements disposed for deflecting interference fit to the bearing housings whereby the brush is positively retained in a nozzle assembly to minimize vibrational movement and conduct heat from the housing.

In accordance with yet another aspect of the present invention, the housing includes a motor mount shell portion including a baffle wall extending from a housing outer wall to contiguous engagement to the motor. The housing outer wall includes a plurality of air inlet slots and air outlet slots oppositely spaced about the baffle wall whereby motor cooling air is kept separated from vacuum working air and is drawn in the air inlet slots and expelled from the air outlet slots. The housing includes an air deflector substantially received in the bag assembly having a terminal end portion disposed tapering radially inwardly past the vacuum working air channel from the housing outer wall and bag outer wall whereby the deflector directs the working air to facilitate greater storage of vacuum dirt in the bag and prevents heavy objects received in the bag from rolling back into the housing and contacting the fan. The housing preferably comprises first and second half shells, fixedly engaged, and includes mating tongue in groove sealing about the half shells' perimeters whereby the sealing seals the motor from contamination by dust particles carried by the working air.

One benefit obtained by use of the present invention is a hand vacuum which is compact and lightweight but provides powerful suction with a revolving brush and improved hand vacuum operation.

Another benefit obtained from the present invention is a hand vacuum which provides an improved seal of the bag assembly to the housing.

A further benefit of the present invention is a hand vacuum with a revolving brush having a motor shaft locking surface for locking cooperation with the motor fan in which operation of the brush provides a continuous torque to tighten the fan to the motor shaft.

Yet another benefit of the present invention is a hand vacuum housing including a stone shield to block potentially damaging items from impinging against the housing side walls, a motor mount shell which segregates motor cooling air from vacuum working air, and further includes an air deflector received in the bag assembly to facilitate greater storage of vacuumed dirt and block heavy objects received in the bag from rolling back into the housing and contacting the fan.

Other benefits and advantages for the subject new hand vacuum will become apparent to those skilled in the art upon a reading and understanding of this specification.

BRIEF DESCRIPTION OF THE DRAWINGS

The invention may take physical form in certain parts and arrangements of parts, the preferred embodiment of which will be described in detail in the specification and illustrated in the accompanying drawings which form a part hereof and wherein.

DETAILED DESCRIPTION OF THE INVENTION

Figure 1:
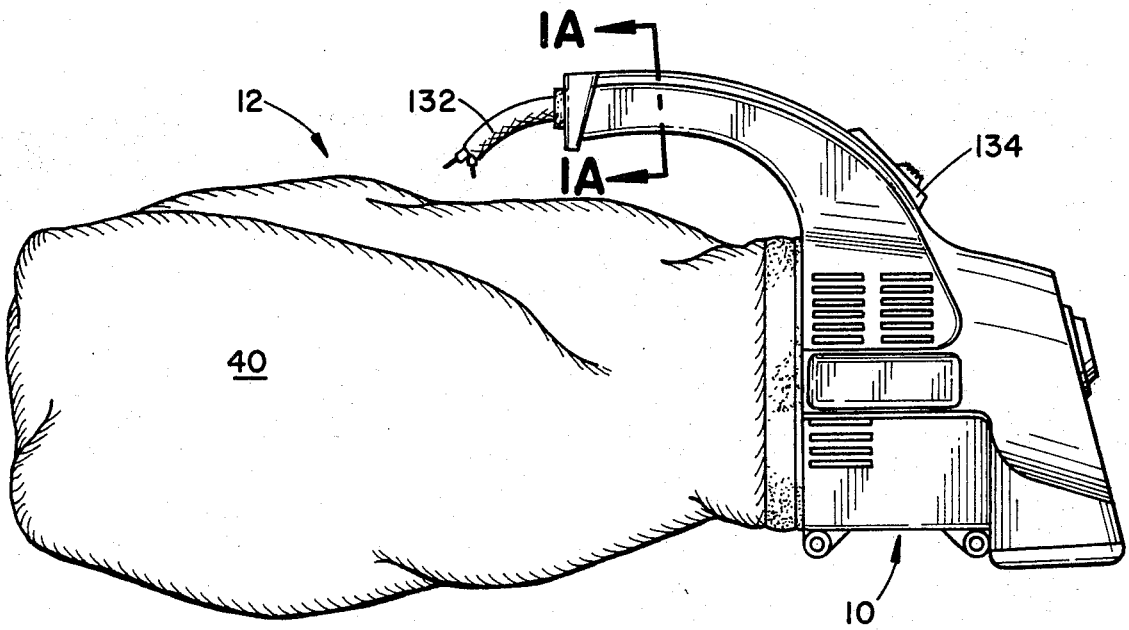
FIG. 1 is a side elevational view of a hand vacuum formed in accordance with the present invention.

Referring now to the drawings wherein the showings are for purposes of illustrating the preferred embodiment of the invention only and not for purposes of limiting same, the FIGURES show a hand vacuum device comprised of a housing 10 and selectively separable bag assembly 12.

Figures 2, 2A, 2B, 2C, 2D:
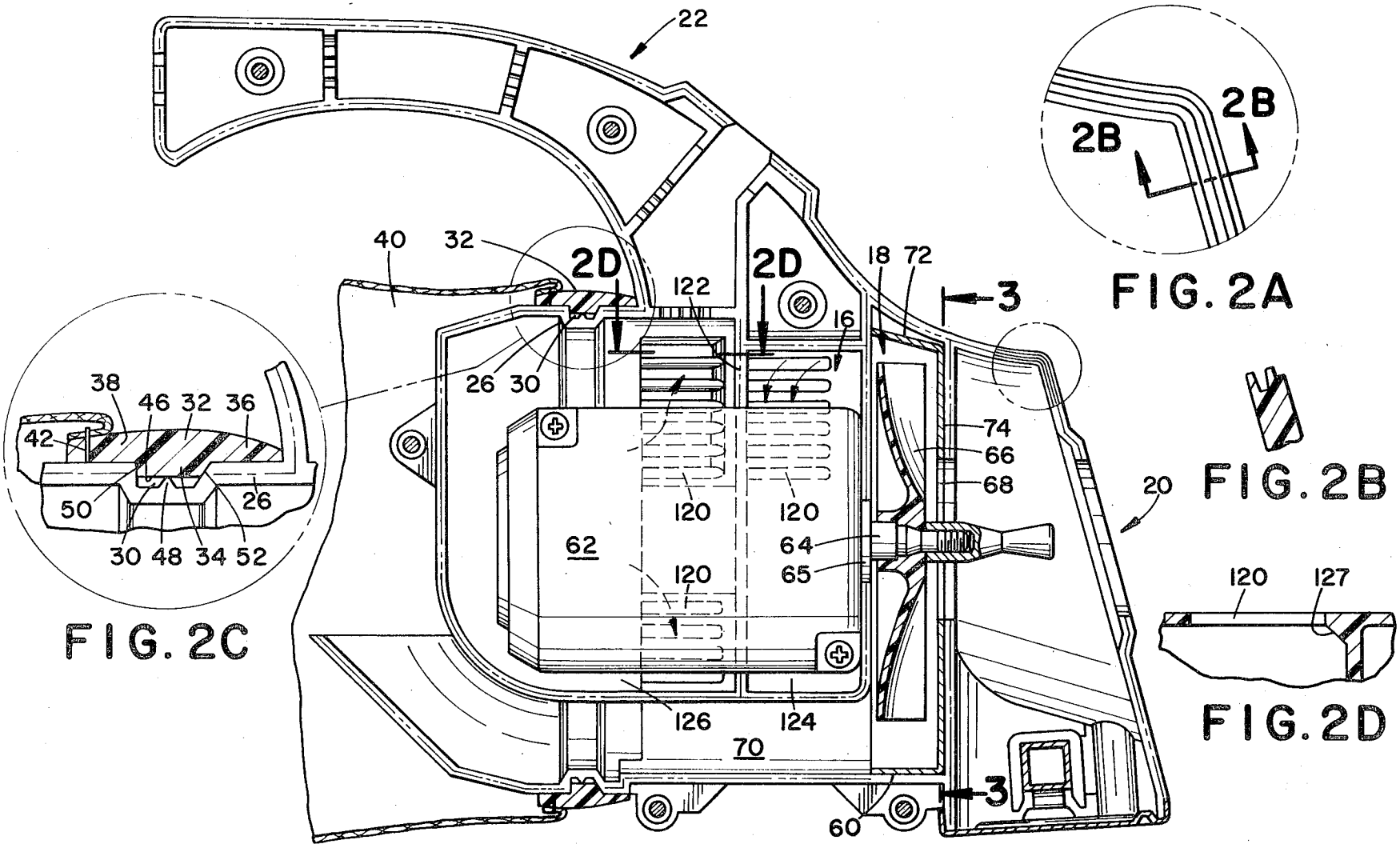
FIG. 2 is an enlarged cross-sectional view of the hand vacuum housing.
FIG. 2A is an enlarged sectional view of FIG. 2 particularly illustrating the tongue in groove assembly of the housing.
FIG. 2B is a cross-sectional view taken along line 2B—2B of FIG. 2A.
FIG. 2C is an enlarged sectional view of FIG. 2 particularly showing the elastomeric retaining ring of the bag assembly as it is received on the hand vacuum housing.
FIG. 2D is an enlarged sectional view of FIG. 2 taken along lines 2D—2D particularly showing an air vent slot construction.

More specifically, and with reference to FIGS. 1 and 2, the vacuum housing 10 includes a motor mount portion 16, a fan chamber 18, a nozzle 20 and a handle 22. An annular bag attachment collar 26 is provided for attachment of the bag assembly 12 to the housing 10. The collar 26 includes a recessed slot area 30 extending circumferentially about the housing 10.

The bag assembly 12 includes an elastomeric retaining ring 32 having a sealing and retaining bead 34 (FIG. 2C) for reception in the recessed slot area 30 whereby the bag assembly 12 is positively sealed during cleaner operation to substantially preclude passing of dust particles out of the bag past the retaining ring 32. The retaining ring 32 includes a lead on flange 36 and a bag assembly attachment flange 38, the bead 34 depending radially inwardly from these flanges and being positioned generally intermediate of the flanges. A receptacle bag 40 of the bag assembly constructed of a conventionally known cotton twill used for vacuum cleaner bags is fixed to ring 32 at the bag assembly attachment flange 38 with a high strength thread 42. A bottom wall 46 of the sealing and retaining bead 34 contacts a projection 48 in the recess slot area 30 and is slightly deformed about the projection by high contact pressure created by the hoop strength of the retaining ring 32. Such a structure provides a very positive seal and eliminates the problems of fine dust particles passing out of the bag assembly 12 during operation of the cleaner.

Three pressure surfaces on the bead 34 operate to seal the ring 32 to the collar 26. The bottom wall 46 engaging the projection 48 in the recess slot area 30 produces a high unit pressure where the projection 48 engages bead 34. It should be noted that the elastomeric ring 32 possesses a hoop strength due to its elastomeric nature and it is sized for a close fit over the collar 26. The sealing force of the projection 48 engaging the elastomeric wall 46 is greater than the air pressure to leak through the seal and accordingly precludes the leaking of the fine dust particles.

A second pressure surface occurs at the point designated by numeral 50 in FIG. 2C at the bead vertical wall engaging the opposed recess slot area vertical wall. This pressure is produced by the back pressure in the bag 40 during operation as a result of the forcing of air into the bag 40.

The third pressure point occurs at an area designated by the numeral 52 where the sloping wall of the recessed slot area 30 contacts the front wall 53 of the bead 34 to produce a pressure area which is the result of the natural hoop strength of the elastomeric retaining ring and a preselected interference fit between the ring and the attachment collar.

A pull tab (not shown) is sewn into the retaining ring 32 to facilitate easy separation of the bag assembly 12 from the housing 10. The ring 32 is sized relative to the collar 26 such that the ring is stretched 5–7% to move the bead 34 into the recessed slot area 30. Such stretching produces the hoop strength earlier mentioned. The seal design has been optimized to give proper and improved sealing while allowing ease in attachment and removal of the bag assembly. The retaining ring 32 is not only decorative but is constructed to minimize the material in the part and yet give proper cross-sectional area to produce a quality seal over repeated stretchings.

Figure 3:
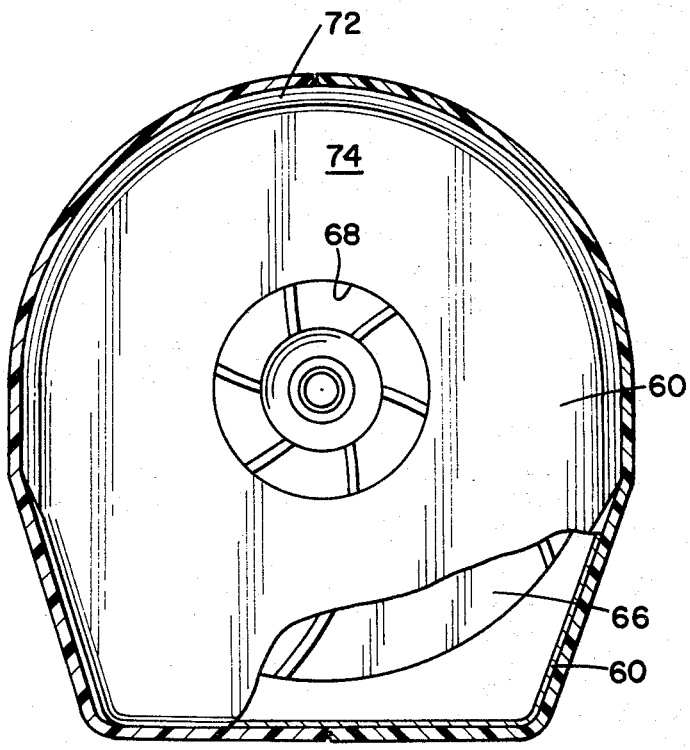
FIG. 3 is a cross-sectional view taken along line 3—3 of FIG. 2.

With reference to FIGS. 2 and 3, the hand vacuum housing 10 is preferably constructed of a lightweight plastic. However, most lightweight plastics which are normally satisfactory for such a housing construction present a problem when they are subjected to repeated impingements from the kind of articles which may be sucked in by hand vacuum. Such articles comprise small pebbles, coins, screws, nails, etc., which, upon being drawn into the fan chamber 18 are oftentimes propelled against the chamber side walls by the fan before passing out of the chamber with the working air. The present invention includes a stone shield 60 to block the potentially damaging effects of such propelled objects.

With continued reference to FIGS. 2 and 3, the housing 10 contains a motor 62 having a motor shaft 64 supported in bearing 65 to which a fan 66 is mounted in fan chamber 18. Working air drawn in through nozzle 20 and through fan chamber ingress aperture 68 is expelled from the chamber through channel 70. The channel 70 is spaced from the motor mount portion 16 by the motor mount portion peripheral wall to provide a working air channel unobstructed by cooling air passageways. Intermediate the housing side wall periphery and the fan 66, the stone shield 60 blocks heavy objects that may be propelled against the housing side walls. Preferably stone shield 60 is constructed of aluminized cold rolled steel. It is circumferentially spaced from the fan so as not to interfere with the fan's rotation and includes a peripheral side wall 72 and a front wall 74. The front wall is contiguous to the nozzle 20 and comprises the ingress aperture 68 for the working air. The side wall 72 includes an upper portion tapered away from the front wall 74 to preclude perpendicular impingement of the items against the side wall over that portion. After impingement against the stone shield, objects are communicated out of the fan chamber 18 through the channel 70.

Figure 7:
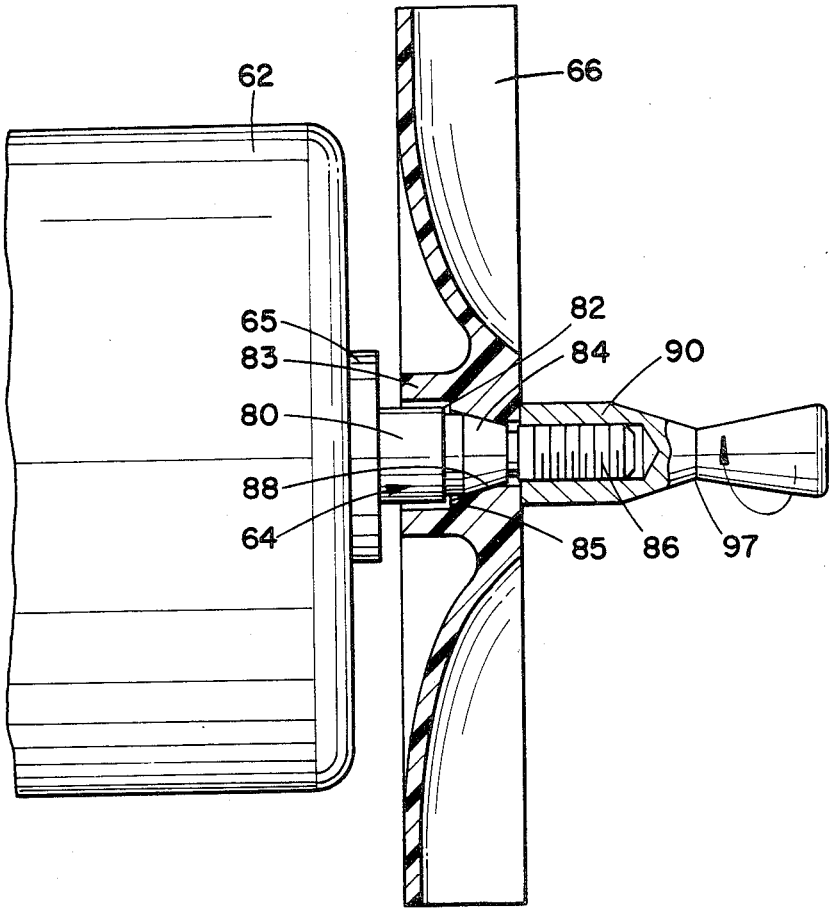
FIG. 7 is an enlarged elevational view in partial section of the motor and fan assembly.

With particular reference to FIGS. 2 and 7, the present invention includes an improved structure for mounting the fan 66 to the motor 62. Projecting out from the motor mount portion 16 of the housing 10 and into the fan chambers 18 is the motor shaft 64 supported in bearing 65. This shaft is driven in rotation by the motor. The shaft 64 includes three portions. A first portion or support shoulder 80 having a generally cylindrical configuration is loosely received in a fan first bore chamber 82 defined by fan bore lead-on flange 83 and fan counterbore shoulder 85. Depending from the support shoulder portion 80 is a tapering fan bore locking surface 84. The end portion of the shaft 64 comprises a threaded portion 86. It is to be particularly noted that shaft locking surface 84 is closely received against a tapered wall portion 88 of the fan 66 such that the mating tapers of surface 84 and wall portion 88 can cooperate through engagement to lock the fan 66 to the shaft 64 upon sufficient urging of the fan 66 towards the motor 62. In other words, the mating reception of the shaft taper into the fan bore taper locks the fan to the motor shaft when the fan is sufficiently pressed onto the motor shaft.

Sufficient urging is realized by threaded reception of a shaft extension 90 onto the shaft threaded portion 86. However, the mere fastening of the shaft extension 90 to the shaft by threading it down until the fan is locked to the motor shaft is clearly not sufficient to maintain the fan in a tightly locked condition to the shaft when subjected to the relatively intense vibration and high speed rotation of the vacuum motor and shaft. Accordingly, an additional force is required to continue to tighten the shaft extension 90 onto the shaft portion 86 while abutting the fan 66 to maintain the locking reception.

Figure 6:
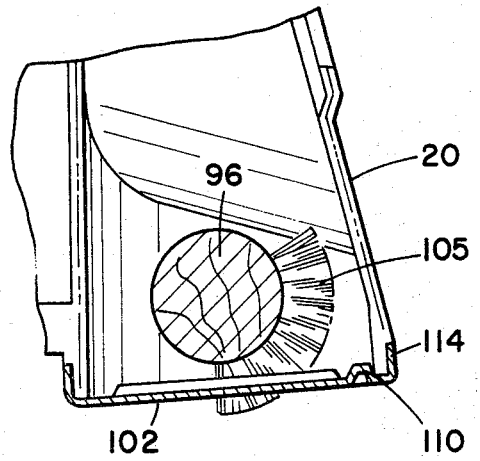
FIG. 6 is a cross-sectional view taken along line 6—6 of FIG. 4.

The revolving brush 96 (FIGS. 4 and 6) is rotated by a belt (not shown) received around the brush at an intermediate portion generally immediately below the shaft extension 90. The belt is received on the shaft extension at generally its point of lessermost diameter 97 (FIG. 7). The belt is constructed of an elastomeric material and is stretched over the distance from the brush 96 to the shaft extension 90 to maintain a gripping action on both the shaft extension 90 and the brush 96. During operation of the cleaner, a torque is applied by resistance of the belt and brush to motor shaft rotation to the shaft extension 90 to continually tighten down the shaft extension 90 onto the threaded portion 86. The continual tightening of the shaft extension 90 during operation continuously urges the shaft extension 90 into abutting engagement with the fan 66 to urge the fan towards the motor 62 and maintain a tight locking reception of the shaft locking surface 84 against the fan tapered wall portion 88.

Conventional fan fastening techniques such as aerodynamic sealing or internal threading of the fan for reception on a threaded shaft portion is obviated with the structure of the present invention. Several advantages of this structure include the lower cost of production of both the motor and the fan. Since there is no necessity to machine or mold a thread on either the fan or motor shaft, manufacturing cost is less. In addition, assembling cost is also less because the fan does not have to be spun onto the shaft. Another advantage is that the positive locking connection between the fan and the shaft is effected without putting excessive stress on the fan. Fan internal thread fastening schemes oftentimes result in large torque and stress forces being exerted on the threads which possibly distort the fan during operation. Yet another feature of the present invention is that such a fan mounting structure absorbs impact loads on the fan better. When a foreign object impinges the fan, the fan has a greater tendency to give against the load than a threaded mounting structure.

This allows the fan to act somewhat as a shock absorber to heavy objects that are drawn into the cleaner.

With reference to FIGS. 2, 4, 5, and 6, it may be seen that the nozzle portion 20 of the present invention houses the revolving brush 96. The brush 96 includes opposed end bearings 98 which support the brush and allow its rotational movement. The nozzle includes integrally formed opposed bearing housing cavities 100 sized to closely receive the bearing housings of the brush. A nozzle guard 102 is fastened to the nozzle portion 20 with conventional threaded fasteners (not shown) inserted into receiving members 104. The nozzle guard has openings through which brush elements 105 extend and through which vacuumed dirt may pass. The guard 102 further includes bearing housing retaining elements 106 which impart the force to retain the brush 96 in cavities 100. The retaining element 106 is sized such that there is an interference fit against the bearing 98 due to deflection of the clip element 106 which holds the brush solid within the nozzle. The brush 96 is normally unbalanced and will want to vibrate during operation. There is thus a necessity that the brush be positively retained in as close a fit as possible to minimize vibrational movement.

Another feature of the retaining element is that the nozzle guard is preferably constructed of metallic material as is the bearing assembly 98. The retaining element 106 thus can operate as a source of heat transfer. Since the bearing 98 is also in contact with the plastic nozzle housing at the cavities 100, heat must be dissipated through the retaining element 106 and out through the sole plate portion of the nozzle guard 102.

Figure 4:
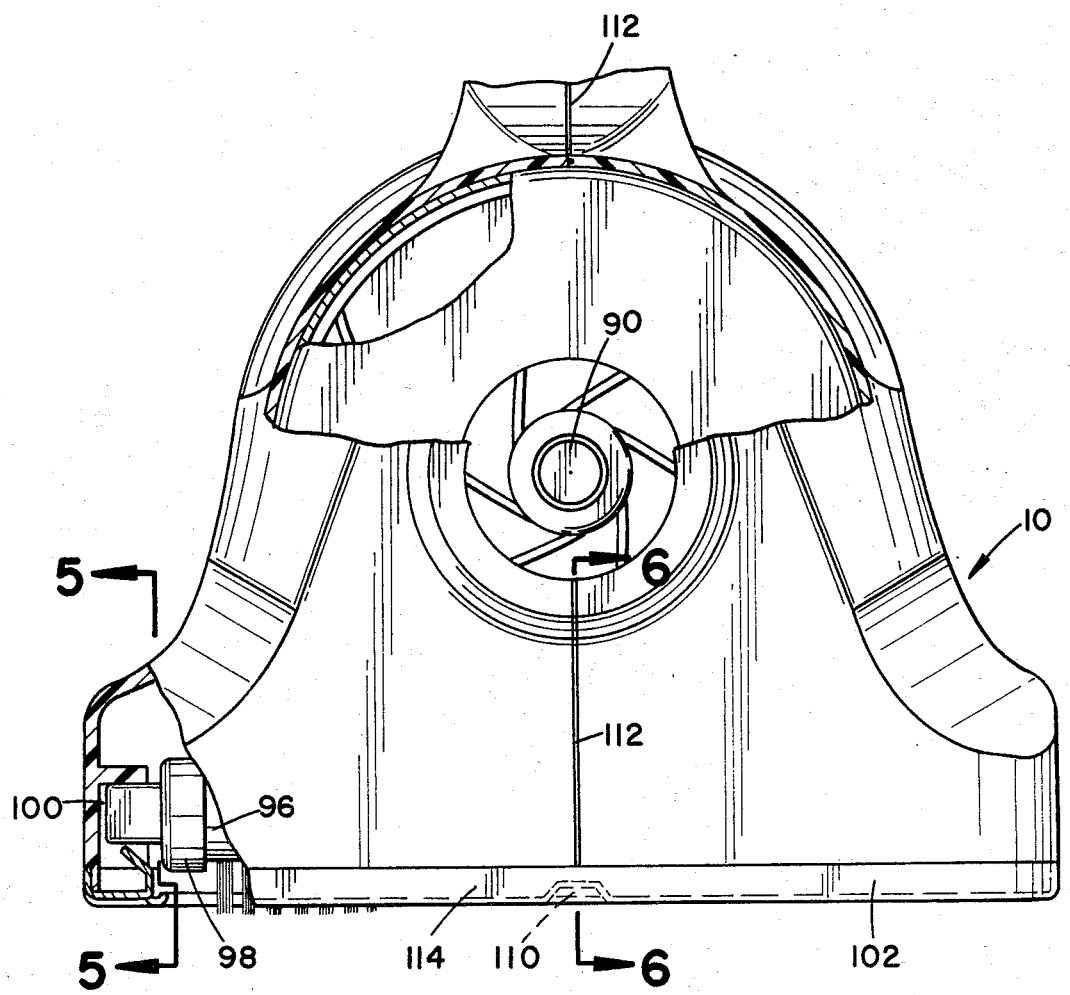
FIG. 4 is an enlarged front elevational view with partial cutaways in section of the present invention.
Figure 5:
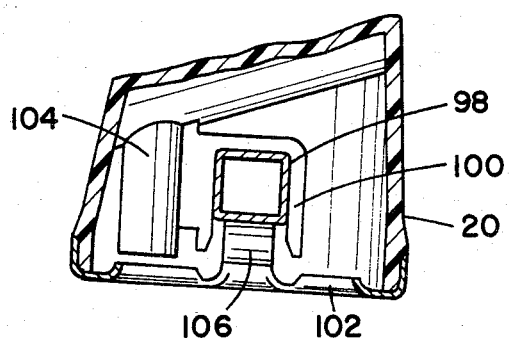
FIG. 5 is a cross-sectional view taken along line 5—5 of FIG. 4.

The nozzle guard 102 also includes a locating and locking protruding dimple 110 disposed for cooperative association with the nozzle whereby the nozzle and nozzle guard are in cooperative support. With particular reference to FIG. 4, the housing 10 is constructed of opposed first and second half housing elements which mate along a center line 112. To buttress the housing, and in particular the nozzle 20 at the center line, dimple 110 in combination with the nozzle guard front wall 114 support the nozzle at its terminal end portion about the center line 112. Such structure minimizes damage to the cleaner by deflection or separation of the housing half elements at the nozzle terminal end portion.

With particular reference to FIG. 2, it can be seen that the housing 10 includes a motor mount portion 16 for receiving the motor 62 that includes a plurality of air vents 120 provided for communicating the ingress and egress of cooling air to the motor 62. A baffle wall 122 engages the periphery of the motor 62 to define a motor cooling air intake chamber 124 and an exhaust chamber 126. The motor 62 includes a cooling air fan (not shown) which draws cooling air in through the vents 120 of the intake chamber 124 into air vents (not shown) of the motor, through the body of the motor, out motor vents in the exhaust chamber 126 and ultimately out into the environment through the air vents 120 in the exhaust chamber 126. The baffle wall 122 precludes cooling air exhausted from the exhaust chamber 126 from intermixing with air in the intake chamber 124 without passing through the motor 62. In addition, the vents 120 in exhaust chamber 126 include a sloped side wall 127 (FIG. 2D) contiguous to the baffle wall 122 and the vents of the intake chamber 124. The sloped side wall 127 effectively directs the exhaust air towards the rear of the cleaner and away from the vents of the intake chamber 124 to inhibit mixing of exhaust cooling air with intake cooling air.

With particular reference to FIGS. 2A and 2B it is important that the cleaner be sealed in a manner that will preclude mixing of cooling air and working air so that the motor 62 is not exposed to vacuumed dirt and yet will provide a strong and durable seal that is easy to assemble. The invention employs a tongue in groove mating fit along the entire periphery of the cleaner between opposing first and second housing halves and about the periphery of the motor mount portion 16.

Figure 1A:
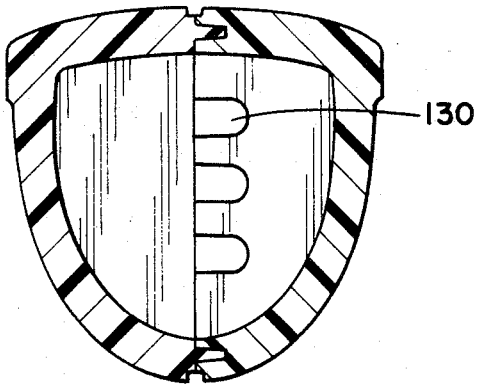
FIG. 1A is a cross-sectional view taken along line 1A—1A of FIG. 1 particularly illustrating assembly aid wire grooves in the vacuum handle.

The housing handle 22, as may be seen from FIG. 1A, further includes besides the tongue in groove sealing, several assembly aid wire grooves 130 for communicating switch wires from the cleaner cord 132 to the cleaner on/off switch 134 (FIG. 1).

The invention has been described with reference to the preferred embodiment. Obviously, modifications and alterations will occur to others upon the reading and understanding of the specification. It is our intention to include all such modifications and alterations insofar as they come within the scope of the appended claims or the equivalents thereof.

Having thus described our invention, we now claim:

1. A hand-held vacuum cleaner including a housing comprising mating first and second half housing elements, said housing having a handle and a nozzle, a motor having means for drawing cooling air through the motor, a selectively-separable bag assembly, a working air channel for communicating working air from said nozzle to said bag assembly, and a motor mount portion receiving said motor and spaced from said working air channel by a motor mount portion peripheral wall;

said motor mount portion including a peripheral motor cooling air intake chamber, a peripheral motor cooling air exhaust chamber and a peripheral baffle wall extending from a housing outer wall to contiguous engagement to said motor, said housing outer wall including a plurality of air inlet vents at said cooling air intake chamber, oppositely disposed in said first and second half housing elements, for cooling air inflow to said motor from said first and second half housing elements, and air outlet vents at said cooling air exhaust chamber, oppositely disposed in said first and second half housing elements for cooling air exhaust from said motor through said first and second housing elements, said inlet and outlet vents being oppositely spaced about said baffle wall, said means for drawing cooling air through the motor causing the cooling air to enter said inlet vents and chamber and exit the outlet chamber and vents;

said sealing peripheral wall adjacent said working air channel sealing said intake and exhaust chambers from said channel to preclude cooling air in said cooling air intake and exhaust chambers from mixing with working air in said working air channel.

2. The cleaner as claimed in claim 1 wherein said housing includes an air deflector substantially received in said bag assembly having a terminal end portion tapering radially inwardly past said working air channel from said housing outer wall whereby said deflector directs the working air to facilitate greater storage of vacuumed dirt in the bag and prevents heavy objects received in the bag from rolling back into the housing and contacting the fan.

* * * * *